US005520380A

United States Patent [19]

Martin et al.

[11] Patent Number: 5,520,380

[45] Date of Patent: May 28, 1996

[54] DOUBLE PICK SEPARATOR DEVICE AND FLAT OBJECT UNSTACKING DEVICE EQUIPPED WITH THIS SEPARATOR

[75] Inventors: Philippe Martin, Valence; Jean-Marc Teluob, Guilherand; Jean-Luc Astier, La Roche de Glun, all of France

[73] Assignee: Compagnie Generale D"Automatisme CGA HBS, Bretigny sur Orge, France

[21] Appl. No.: 309,058

[22] Filed: Sep. 20, 1994

[30] Foreign Application Priority Data

Sep. 27, 1993 [FR] France ..... 93 11457

[51] Int. Cl.[6] ..... B65H 3/12

[52] U.S. Cl. ..... 271/94; 271/12; 271/104

[58] Field of Search ..... 271/94, 104, 11, 271/12

[56] References Cited

U.S. PATENT DOCUMENTS

| | | | |
|---|---|---|---|
| 2,761,680 | 9/1956 | Lens | 271/12 |
| 3,126,200 | 3/1964 | Rehm | 271/94 |
| 3,126,201 | 3/1964 | Rehm | 271/104 |
| 5,290,022 | 3/1994 | Sabatier et al. | 271/12 |

FOREIGN PATENT DOCUMENTS

| | | |
|---|---|---|
| 0525582A1 | 2/1993 | European Pat. Off. . |
| 2323609 | 4/1977 | France . |
| 2674777A1 | 10/1992 | France . |
| 1267012 | 4/1968 | Germany . |

*Primary Examiner*—William E. Terrell
*Assistant Examiner*—Tamara Kelly
*Attorney, Agent, or Firm*—Sughrue, Mion, Zinn, Macpeak & Seas

[57] ABSTRACT

Double pick separator device comprising means for retaining a flat object which might otherwise be entrained by friction by another flat object being moved in a predetermined transfer direction by transfer means.

The retaining means are mounted on a structure mobile in a direction substantially perpendicular to the transfer direction. The separator device further comprises means for exerting a holding force on the retaining means, said holding force being oriented in a holding direction substantially perpendicular to the transfer direction.

Application to automatic mail sorting, especially to sorting mail items of varying thickness.

7 Claims, 1 Drawing Sheet

FIG.1
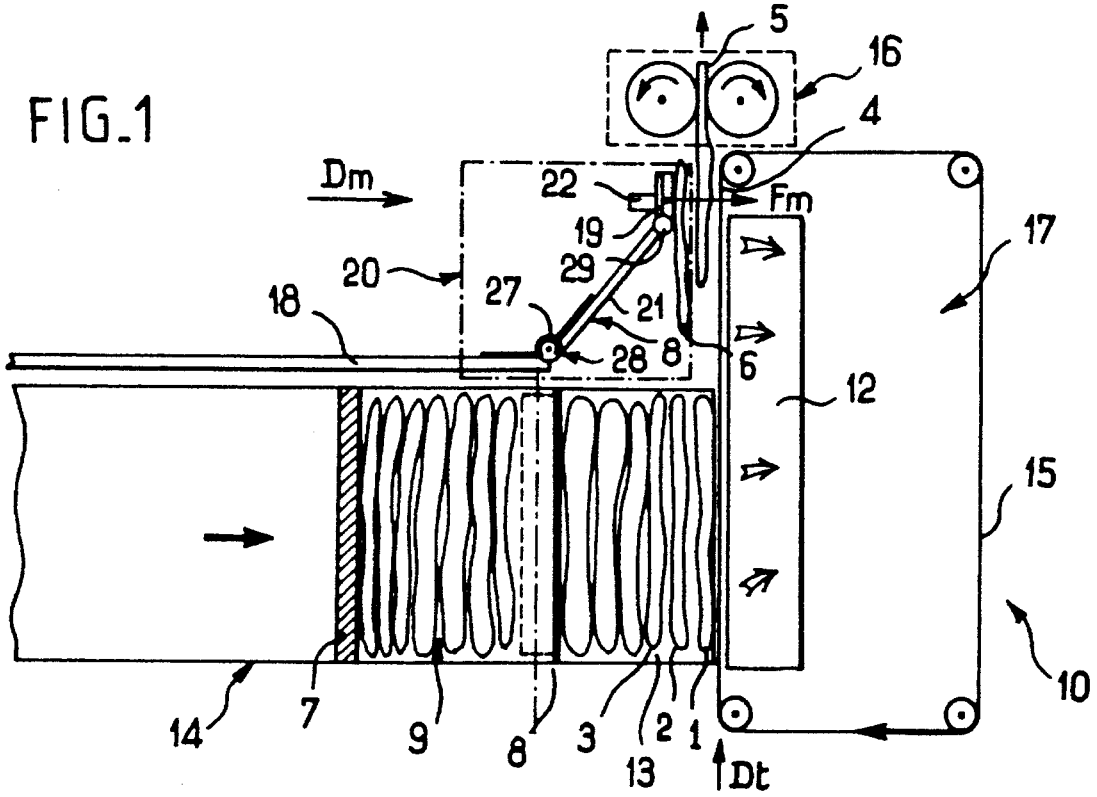
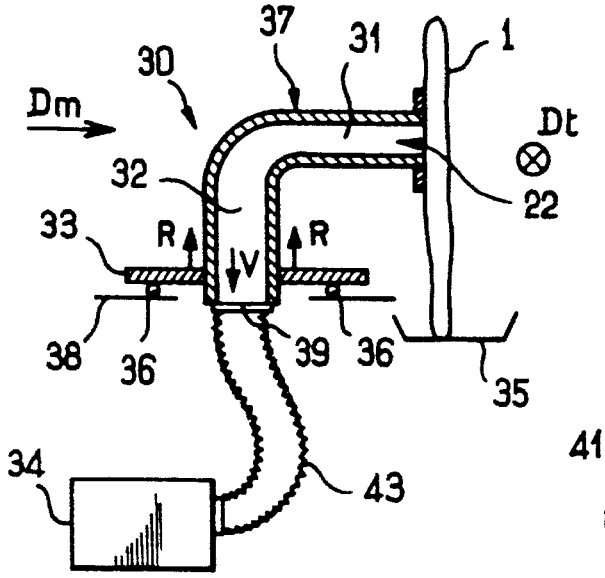
FIG.2
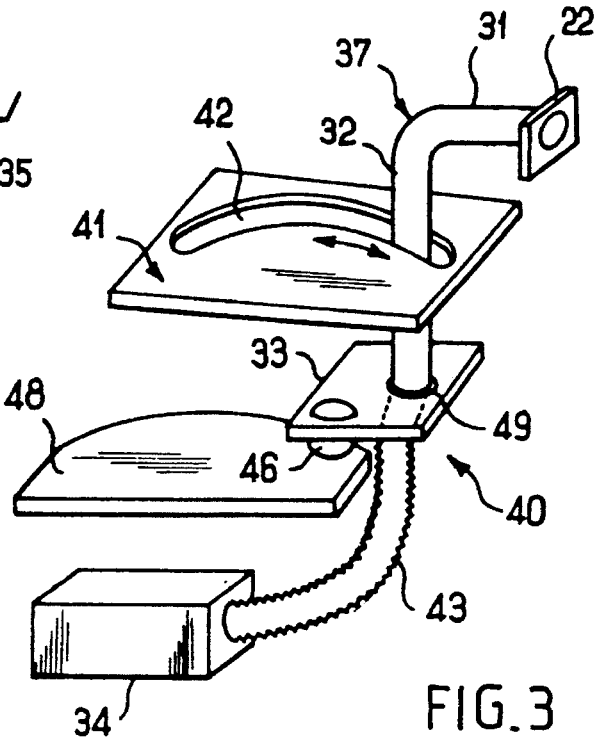
FIG.3

DOUBLE PICK SEPARATOR DEVICE AND FLAT OBJECT UNSTACKING DEVICE EQUIPPED WITH THIS SEPARATOR

The present invention concerns a double pick separator device. It is also directed to a flat object unstacking device equipped with this separator device.

BACKGROUND OF THE INVENTION

A flat object unstacking device comprises four main units:

a mail feed magazine, a mail holding device, a double pick separator, a transfer or take-off device.

The mail is stood on edge on a belt with its back against a plate. The belt and the plate are driven simultaneously so that the mail is moved towards the holding device. The belt leads to a sudden change in level, referred to hereinafter as the drop. The mail items then drop into a feed magazine adjacent the mail holding device.

The holding device has suction areas across which a perforated belt passes.

On leaving the holding device the mail passes across the suction area of the double pick separator on the opposite side of the belt. This unit retains mail items that might otherwise be entrained by friction by the preceding mail item so that only one mail item at a time can leave.

On leaving the double pick separator the mail is taken into a take-off device which constitutes an interface between the unstacking device and a sorting device.

French patent application No. 91 09431 of 25 Jul. 1991 in the name of this Applicant discloses a device for unstacking flat objects including a retaining unit serving as a double pick separator. This retaining unit is in the form of a suction head acting on the back of an unstacked mail item. It is on the upstream side of a transfer device comprising two drive belts and is activated when a flat object is taken up by this transfer device. The retaining unit is fixed to the frame of the feed magazine. This imposes a limit on the thickness of a flat object.

French patent application No. 91 04048 of 3 Apr. 1991 discloses a double pick separator device including a continuously acting suction unit having a flat side across which move the two flat objects to be separated, which are held against this flat side, and a scraper unit which can reciprocate perpendicularly to this flat side. The scraper unit comprises a casing inside which the pressure is lower than that in the suction unit, a carriage supporting the scraper unit casing, means for moving the carriage to apply the casing to the two contiguous objects and means for automatically retracting the carriage. This separator device can have the following drawbacks:

It may be desirable for the separator not to be retracted, for example in the presence of a floppy mail item, to prevent excessive deformation of the mail item, and this retraction, which is by a predetermined amount, prevents the processing of thick mail items.

OBJECTS AND SUMMARY OF THE INVENTION

An object of the present invention is to propose a double pick separator which can retain flat objects that might otherwise be entrained by the preceding mail item by friction, regardless of the thickness of the objects and their lateral position at the time of transfer.

In the double pick separator device of the invention comprising means for retaining a flat object which might otherwise be entrained by friction by another flat object being moved in a transfer direction by transfer means operating on one side of it, said retaining means are mounted on a structure mobile in a direction substantially perpendicular to the transfer direction and further comprising means for exerting a holding force on the retaining means, said holding force being oriented in a holding direction substantially perpendicular to the transfer direction.

The use of a mobile structure supporting the retaining means allows mail items of varying thickness to be processed, unlike the prior art separators which have the drawback of being fixed.

In another aspect the invention proposes a flat object unstacking device comprising flat object feed means, flat object holding means, a double pick separator device according to the invention comprising retaining means, and transfer means, wherein the separator device is between the holding means and the transfer means and wherein the retaining means are controlled in such a way that a retaining force is exerted each time an object is entrained by the transfer means.

BRIEF DESCRIPTION OF THE DRAWINGS

Other features and advantages of the invention emerge in the following description. In the appended drawings given by way of non-limiting example:

FIG. 1 is a simplified top view of a flat object unstacking device equipped with a double pick separator of the invention;

FIG. 2 is a side view partly in cross-section of a double pick separator of the invention;

FIG. 3 shows one specific embodiment of a double pick separator of the invention.

MORE DETAILED DESCRIPTION

A flat object unstacking device equipped with a double pick separator of the invention and the operation of the double pick separator will now be described with reference to FIGS. 1 to 3.

An unstacking device 10 comprises a moving belt 14 on which flat objects 9 such as mail items are placed with their back against a plate 7 moving at the same speed as the belt 14, a feed magazine 13 into which mail items 1, 2 and 3 drop after leaving the conveyor belt 14, a holding device 17, a double pick separator 20 and a transfer device 16. The holding device 17 comprises a perforated belt 15 running around pulleywheels. A suction device 12 inside the belt produces a suction area facing the feed magazine 13 and the double pick separator 20.

The double pick separator 20 comprises a first part 21 joined to the frame 18 of the unstacking device 10 by a first articulation 28 whose axis is substantially parallel to the axes of the pulleywheels of the holding device 17 and a second part 19 joined to the first part 21 by a second articulation 29 whose axis is substantially parallel to the axis of the first articulation 28. The second part 19 supports a suction head 22 connected to a vacuum generator device (not shown in FIG. 1).

A holding device 27 such as a torsion spring or the like is provided at the first articulation 28 to apply a holding force Fm and thus to hold the second arm 19 and the suction head 22 in contact at all times with the flat object or objects between said second arm 19 and part of a holding side 4 of the holding device 17 facing the double pick separator 20.

Thus when mail items 1–3 have left the conveyor belt 14 at a drop 8 and end up in the feed magazine 13, the first mail item 1 in the stack is sucked onto the holding device 17 and then moved towards the transfer device 16 by the perforated belt 15. It is then drawn towards and swept into the transfer device (16) where it is pinched between the double pick separator (20) and the holding side 4.

The separator 20 is activated by the front edge of an "object" which is either a single mail item or a double pick. This activation can be commanded (for example) by the covering of a sensor (not shown) at the separator 20. The latter is de-activated by the rear edge of the "object" when it uncovers another sensor (also not shown).

If there is only one mail item at the double pick separator 20 before it is taken up by the transfer device 16 the separator 20 is activated anyway when the first sensor is covered. However, this single mail item is at the same time entrained by the holding device 17 into the transfer device 16 where it is immobilized pending its transfer to sorting devices (not shown) and the separator 20 is de-activated as soon as the second sensor is uncovered.

On the other hand, if a second mail item 6 is entrained with a first mail item 5 by friction, and therefore constitutes an "object", the suction head 22 of the separator 20 holds back the unwanted second mail item 6 so that only the first mail item 5 in contact with the belt 15 is transferred towards the transfer device 16. The second mail item 6 is then processed in its turn. The articulations 27, 29 of the double pick separator 20 cater for flat objects of any thickness by keeping the second arm 19 and the suction head 22 substantially parallel to the mail item at all times, regardless of its thickness and without compromising the efficient and automatic sorting of the mail items.

The double pick separator must be retractable by the flat objects with a low force to avoid all risk of damage to delicate mail items or of jamming of the unstacking device 10. The suction head 22 must therefore be appropriately connected to a suction generator 34, so that the suction head 22 is not subjected to antagonistic forces due to the vacuum which would have to be compensated. This connection must also track the retraction due to thick mail items and it must have negligible stiffness. A separator sliding in the pipe is not satisfactory because the force due to the vacuum would oppose that of the spring holding the separator against the objects. An oscillatory movement would then move the separator away from the mail at the wrong time. FIG. 2 shows an advantageous way to connect the suction head 22 of a double pick separator 30 of the invention to the generator 34. The double pick separator 30 comprises a first rigid pipe 37 forming an elbow and having a first part 31 whose end serves as the suction head 22 and is in contact with a flat object 1 resting on a transfer support 35 and moving in a predetermined transfer direction Dt and a second part 32 whose axis is substantially perpendicular to the first part 31 and passes through a hole 49 in a structure 33 and is thus fastened to the structure 33, which is movable relative to a fixed support 38 in a movement direction Dm substantially parallel to the axis of the first part 31 of the rigid pipe 37. The mobile structure 33 forming an abutment can be equipped with one or more bearing members, for example, such as rollers 36, 37 or like means, such as one or more balls. The end 39 of the second part 32 of the rigid pipe 37 is preferably connected to one end of a flexible pipe 43 whose other end is connected to the generator 34.

Thus when a mail item 1 is moved by the holding device 17 in a transfer direction Dt on the transfer support 35 the suction head 31 is held in a holding direction against the side of the mail item facing the separator 30. The ability to retract the pipe 37 in a movement direction Dm perpendicular to the transfer direction Dt caters for mail items of varying thickness. The force V due to the vacuum is compensated by the reaction of the abutment comprising the mobile structure 33 and does not affect the retraction of the separator.

Referring to FIG. 3, in which the articulation parts are not shown, in one specific embodiment of a double pick separator 40 the rigid elbow pipe 37 is guided by a guide member 41 which has a slit 42 whose shape substantially matches the path of movement of the second part 32 of the rigid pipe 37, which is a circular arc, for example. The mobile structure 33 attached to the rigid pipe 37 is provided with an abutment comprising, for example, an abutment ball 46 in contact with a frame plane 48. This decouples the force due to the vacuum and the holding force due to the spring, the effect of which is to limit the risk of unwanted oscillation of the suction head.

Of course, the invention is not limited to the examples that have just been described and these examples can be modified in many ways without departing from the scope of the invention. For example, there are many ways of holding the separator against the flat objects, including the use of compression springs. Many other abutment devices could also be used.

We claim:

1. A double pick separator device comprising:

means for retaining a flat object which might otherwise be entrained by friction by another flat object being moved in a predetermined transfer direction by transfer means, said retaining means being mounted on a structure mobile in a direction substantially perpendicular to the transfer direction;

means for exerting a holding force on the retaining means, said holding force being oriented in a holding direction substantially perpendicular to the transfer direction; and conduction means having a first part oriented along a first axis substantially parallel to the holding direction and having at its end a suction head and a second part oriented along a second axis substantially perpendicular to the first axis and having its end connected by a flexible conductor to a suction generator, said second part being fastened to an abutment mobile relative to a frame plane.

2. A separator device according to claim 1, wherein the retaining means comprise a suction head connected by conduction means to suction generator means.

3. A separator device according to claim 1, wherein the mobile structure comprises a first arm connected by first articulation means to a frame and a second arm connected by second articulation means to the first arm, said second arm carrying the retaining means and being held substantially parallel to the transfer direction.

4. A separator device according to claim 3, wherein the first and second articulation means have axes substantially perpendicular to the transfer direction and to the holding direction.

5. A separator device according to claim 1, wherein the means for exerting a holding force comprises a torsion spring.

6. A separator device according to claim 1, wherein the second part of the rigid conduction means is guided by a guide member.

7. A flat object unstacking device comprising flat object feed means, flat object holding means, a double pick separator device according to claim 1, and transfer means, wherein the separator device is in the immediate vicinity of the holding means and the transfer means and wherein the retaining means are controlled in such a way that a retaining force is generated each time an object is entrained by the transfer means.

* * * * *